United States Patent [19]

Balzau et al.

[11] Patent Number: 4,472,062

[45] Date of Patent: Sep. 18, 1984

[54] CONTINUOUS MIXING SILO AND METHOD OF OPERATION

[75] Inventors: Gerhard Balzau, Beckum; Günter Kompa, Lippstadt; Frank Schaberg, Oelde; Manfred Steinmann, Beckum; Helmut Kucharski, Beckum, all of Fed. Rep. of Germany

[73] Assignee: Krupp Polysius AG, Beckum, Fed. Rep. of Germany

[21] Appl. No.: 437,824

[22] Filed: Oct. 29, 1982

[30] Foreign Application Priority Data

Nov. 2, 1981 [DE] Fed. Rep. of Germany ..... 3143387

[51] Int. Cl.[3] ..... B01F 13/02

[52] U.S. Cl. ..... 366/106; 366/107; 222/195; 406/85

[58] Field of Search ..... 366/101, 106, 107; 406/12, 85, 90, 91, 138; 222/195, 630; 34/57 A

[56] References Cited

U.S. PATENT DOCUMENTS

| | | | |
|---|---|---|---|
| 3,159,383 | 12/1964 | Van Munster | 366/107 |
| 3,386,182 | 6/1968 | Lippert | 366/107 X |
| 3,656,717 | 4/1972 | Klein et al. | 366/106 |
| 3,861,753 | 1/1975 | Lesk et al. | 406/85 X |
| 3,989,147 | 11/1976 | Fried | 406/91 |
| 3,995,771 | 12/1976 | Olivier | 222/195 X |
| 4,239,421 | 12/1980 | Krauss | 366/106 X |
| 4,382,723 | 5/1983 | Möller | 406/90 |

FOREIGN PATENT DOCUMENTS

| | | | |
|---|---|---|---|
| 1129892 | 3/1962 | Fed. Rep. of Germany | 222/195 |
| 2261804 | 2/1974 | France | 366/107 |
| 569509 | 9/1977 | U.S.S.R. | 406/85 |

*Primary Examiner*—Philip R. Coe
*Assistant Examiner*—Frankie L. Stinson
*Attorney, Agent, or Firm*—Learman & McCulloch

[57] ABSTRACT

The invention relates to a continuous mixing silo and a method of operating it for the mixing of fine-grained material. The silo has a base provided with a plurality of zones which are supplied with aerating air in chronological sequence. Individual zones of the base are supplied with additional air in a pulse-like manner at specific intervals of time to achieve intensive aeration and mixing of the material. The additional air is supplied from a storage unit for a shorter period than the aerating air. Air taken from the storage unit is replenished during the time interval between pulses.

19 Claims, 4 Drawing Figures

CONTINUOUS MIXING SILO AND METHOD OF OPERATION

The invention relates to a continuous mixing silo for mixing fine material and to the method of operating the silo.

The known continuous mixing silos to which the invention relates are of relatively large diameter and great height so that large quantities of fine material can be received and mixed, as is necessary for example for the mixing and homogenisation of cement or raw cement dust or for fine-grained or powdered material of a similar nature.

Various silos of the type described above are known in the art in which the silo base is divided into a number of individual aeration sectors or the like at least one of which at any one time has air blown into it from below so that the material located above it is brought into a state in which it is capable of flowing, and thus several layers of material lying one above the other are mixed together and then discharged. Such silos have included the supply of aerating air to the relevant active base sector in a pulsating manner. In these known methods, however, a large quantity of air is necessary and correspondingly costly pulse-control means (for the large quantities of air) are necessary to deliver it in a pulsating manner.

It is also known in the art that fine material may be mixed, preferably intermittently, in relatively small mixing vessels and for the mixing to be aided by introducing pulse-like blasts of air into the material in the container with the aid of individual nozzles or the like. However, these known methods have proved unworkable for the operation of large continuous mixing silos.

A principal object of the invention, therefore, is to provide a silo and method of operation which are particularly suited to the operation of a continuous mixing silo constructed as a large-capacity silo and distinguished by its reliable mixing operation with relatively small quantities of air being required.

This object is achieved according to the invention by supplying the individual regions of the base for specific periods of time with additional air from an air store which is recharged by a fan between such periods of time.

SUMMARY OF THE INVENTION

In the method according to the invention aerating air can be supplied to the individual zones of the base of the continuous mixing silo in much the same way (in chronological sequence) as is known in the conventional methods. The supply of additional air during specific intervals of time greatly intensifies the aeration of the material or the column of material above the respective supply region. That is, during this brief additional supply of air to the respective zone of the base the additional air coming from the air store is in practice pushed upwards through the whole section of the column of material. This operation results in an increased mixing of the various layers of material in the column so that a greatly improved mixing effect of the whole contents of the silo is achieved by comparison with known methods. Thus in the method according to the invention the conventional aeration operation in the individual zones of the base is briefly overlaid by a certain pulse-like supply of additional air. Using this method it is possible on the one hand to restrict the quantity of air required for aerating the material to a minimum and on the other hand only a relatively small quantity of air needs to be supplied as additional air to the corresponding zones of the base.

According to the invention it is advantageous if the additional air is supplied to at least one zone of the base which has just been aerated and at a much higher pressure than the pressure of the aerating air. In an advantageous manner the ratio of the pressure of the aerating air to the pressure of the additional air is chosen to be between approximately 1:5 and 1:10, the pressure of the additional air being approximately between 4 and 8 bars, preferably approximately 6 bars, as a function of the height of the column of material in the silo.

The ratio of the quantity of aerating air to the quantity of additional air depends in part upon the desired aerating and mixing operation which is in turn dependent upon the diameter of the silo and the nature of the material in it.

According to the invention the supply of aerating air can advantageously be switched over to each of the approximately circular sector shaped zones of the base in equal periods and within each of these periods the additional air is supplied and the air store is recharged. Accordingly, if it is assumed that each active base zone is supplied with aerating air in a conventional manner for approximately 6 to 10 minutes, then additional air can be supplied in a pulsating manner to this base zone for 2 minutes so that after this interval of time for the supply of additional air there is still a period of approximately 4 to 8 minutes available in which the air store for the additional air to be completely recharged by a separate fan before the next base zone in the sequence is supplied with aerating air.

A continuous mixing silo suitable for application of the method according to the invention contains a large volume silo compartment, at least one upper material inlet, a silo base which is slightly inclined towards the center and has a plurality of radial pneumatic discharge channels evenly distributed over the circumference, and air boxes arranged in the regions between the discharge channels and supplied with aerating air. There also is at least one material outlet provided in the central region of the base and an arrangement for time-controlled supply of aerating air equipped with a fan and connected to the air boxes.

According to the invention this continuous mixing silo is distinguished in that in each base region between adjacent discharge channels at least one air box is provided in addition to the air boxes supplied with aerating air. Each additional air box is supplied with additional air and is connected to a compressed air storage tank which can be emptied in a pulse-like manner during predetermined intervals of time via the additional air boxes and with which is associated a separate fan for recharging when the tank is inactive.

DESCRIPTION OF THE DRAWINGS

Further details of the invention are set out in the following description of two embodiments which are illustrated in the accompanying drawings in which.

DETAILED DESCRIPTION

Figure 1:
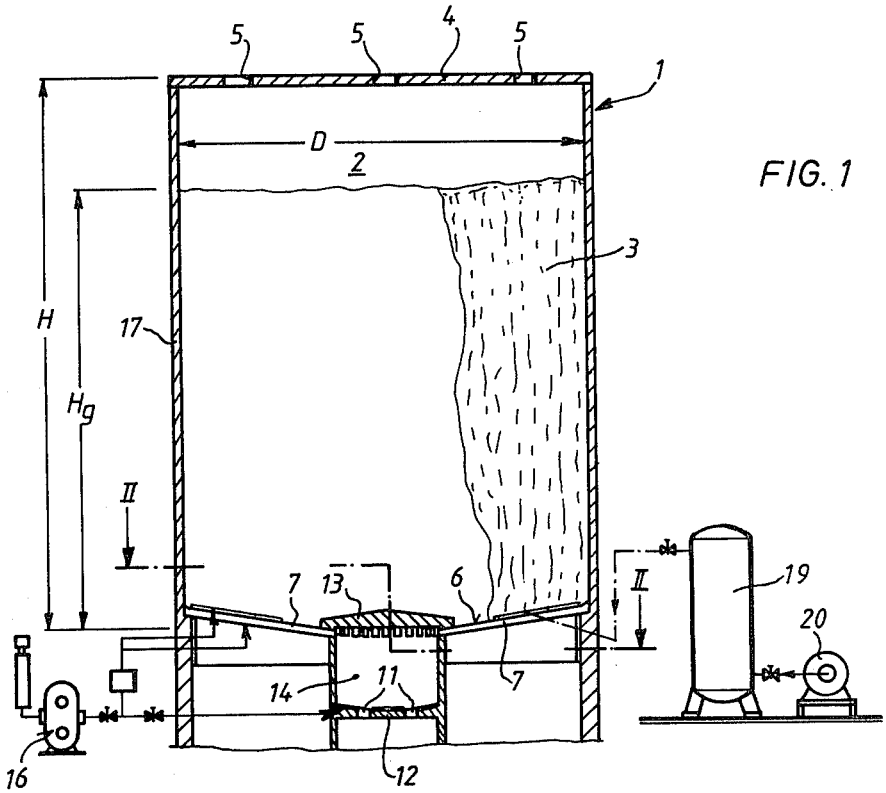
FIG. 1 is a diagrammatic, vertical section through a first embodiment of a continuous mixing silo.
Figure 2:
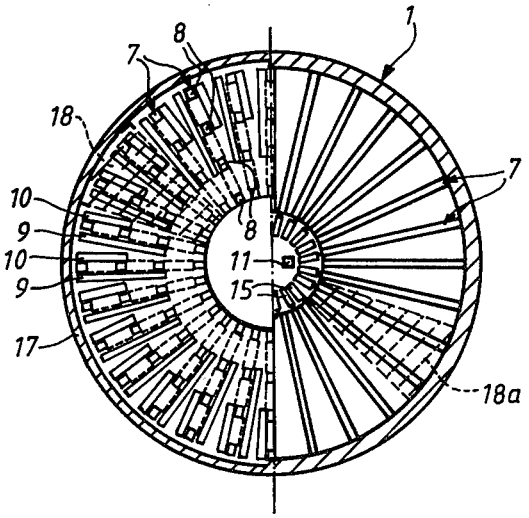
FIG. 2 is a cross-sectional view taken on the line II—II of FIG. 1.

In the first embodiment shown in FIGS. 1 and 2 the continuous mixing silo 1 has a circular cross-section. Its internal diameter D can be 25 m or more, while its internal height H can be 50 m or more, so that in its interior in any case there is a large volume silo compartment 2 to receive fine material 3 which generally does not fill the silo compartment 2 as far as the silo cover 4, but only up to a height $H_g$, so that sufficient free space remains above the column of material for expansion of the aerating air which can be extracted via a filter in a known manner not illustrated in detail.

In the silo cover 4 there is at least one material inlet, but preferably several evenly distributed material inlets 5, through which the material to be mixed can be delivered and distributed over several points.

The lower end of the silo 1 and thus the lower closure of the silo compartment 2 forms a base 6 which is slightly inclined in a conventional manner towards the center in the form of a shallow funnel. A plurality of radial, pneumatic discharge channels 7 are evenly distributed over the circumference of this silo base 6 and are preferably covered on some sections of their length so that they have several material supply holes 8. In the embodiment shown in FIG. 2 each discharge channel has four material supply holes.

Air boxes 9 or 10 having conventional air-permeable covers are arranged in the surface of the base 6 between the discharge channels 7 which are adjacent to each other in the peripheral direction. Air is supplied to the boxes 9 and 10 from below in a manner which will be described in greater detail below in order to assist the mixing and the discharge of the material.

In the central region of the base 6 two material outlets 11 are located in a central circular base part 12 which is arranged considerably lower than the rest of the silo base 6 and is covered by a shallow conical cap 13. In this way a special central discharge chamber 14 is formed which is supplied in its upper part by the discharge channels 7 which are arranged radially in the base 6 with their lower ends extending below the cover 13 and opening into the discharge chamber 14. The central base part 12 containing the two material outlets 11 (in the chamber 14) has evenly distributed air boxes 15 through which aerating air is continuously and evenly supplied during the operation of the silo 1.

The discharge channels 7, the air boxes 9 in the region between the disharge channels 7, and the air boxes 15 arranged in the central base part 12 can be supplied with aerating air in the necessary and conventional manner by a common fan 16, as will be explained in greater detail below.

In the embodiment of FIG. 2 the air boxes 9 and 10 arranged in the silo base 6 are preferably of a long narrow shape and the air boxes 9 have a greater radial length than the air boxes 10 (according to FIG. 2 the air boxes 9 are approximately twice as long as the air boxes 10) and all the air boxes 9, 10 are arranged radially with their outer ends lying approximately in the region of the outer wall 17 of the silo and only extending over a part of the radial dimension of the base. The air boxes 9 and 10 thus each lie in a covered outer annular section of the silo base 6 and are evenly distributed over the silo base 6 in such a way that in each case one air box 9 and one air box 10 lie opposite one another in the region of the long edges of an associated discharge channel 7 and are arranged parallel to this discharge channel 7.

In the embodiment of FIGS. 1 and 2 the air boxes 9 of greater radial length are intended for the supply of the usual aerating air from the fan 16.

In relation to the supply of aerating air (from the fan 16) it should be pointed out at this stage that the silo base 6 is divided in a known manner into a number of air supply zones to which the aerating air is supplied in chronological sequence by the fan 16. A conventional control arrangement, not illustrated in greater detail, ensures that the air supply is switched to the individual zones of the base in an even rhythm in the peripheral direction. In the present example it may be assumed that each of these zones of the base of circular sector shape, as indicated by shading at 18, 18*a*, includes two pneumatic discharge channels 7 with the associated air boxes 9 and 10, and in each active air supply period two base zones 18, 18*a* which lie diametrically opposite one another on the silo base 6 (as indicated in FIG. 2) are supplied simultaneously with aerating air, while the central base part 12 is continuously and evenly supplied with aerating air.

In this continuous mixing silo 1 the air boxes 10 arranged adjacent to the air boxes 9 which are supplied with aerating air have a particular role to play. These air boxes 10 are not connected to the fan 16 but are connected to a compressed air storage tank 19 with which a separate charging fan 20 is associated. With the aid of this compressed air storage tank 19 additional air is supplied via the air boxes 10 for specific intervals of time to the base zones 18, 18*a* which are at the time supplied with aerating air. Each interval of time for the supply of additional air is such that within the whole air supply period in which each base zone 18, 18*a* is supplied with aerating air, sufficient time remains after the pulse-like supply of additional air for the compressed air storage tank 19 to be recharged by the charging fan 20. This means therefore that in the examples according to FIGS. 1 and 2 two diametrically opposed zones (18, 18*a*) on the silo base 6 are simultaneously supplied with aerating air and briefly supplied with pulses of additional air while the central base portion 12 is continuously supplied with aerating air, and the aerating air for the air boxes 9 and 15 and the conveying air for the discharge channels 7 is produced by the fan 16, while the additional air is supplied from the compressed air storage tank 19 via the air boxes 10.

As regards the construction of the air boxes 9 for aerating air and the air boxes 10 for additional air it should be pointed out that the length of these boxes is preferably dependent upon the nature of the material and/or the silo diameter D. In the illustration according to FIG. 2 it is assumed that relatively easily fluidisable and mixable fine material is to be aerated and thus mixed so that only relatively short air boxes 10 are necessary for the additional air and by contrast relatively long air boxes 9 are provided for the aerating air, but an opposite relationship between the length of the aerating air boxes and the additional air boxes can also be selected, particularly when fine material which is especially difficult to mix is to be treated.

The way in which the fine material 3 is mixed in the continuous mixing silo 1 should be clear from the preceding explanation. However, it may be said that during the period of time in which aerating air is supplied at relatively low pressure by the fan 16 to the active base zones 18, 18*a* for conventional aeration, the compressed air storage tank 19 which is at a pressure of approximately 4 to 8 bars, preferably approximately 6 bars, is emptied in a pulse-like manner via the air boxes 10 of the base zones 18, 18*a* during a specific interval of time (e.g. approximately two minutes). With the aid of this brief and pulse-like supply of additional air almost the whole section of the column of material lying above the base zones 18, 18*a* is aerated (over its whole height $H_g$), so that a greatly intensified mixing of the different layers of material is achieved. The material which has been aerated and mixed in this way in the region above the active base zones is then delivered with the aid of the discharge channels 7 to the central discharge chamber 14 in which further mixing can take place before the material is extracted through the material outlets 11. By the use of this type of brief pulse-like supply of additional air it is not only possible to improve the aerating and mixing effect in the respective active base zones, in comparison with the known methods, but also this continuous mixing silo can be operated with a reduced aerating air requirement by comparison with known constructions, and it should be noted that only relatively small quantities of air are necessary as additional air from the compressed air storage tank 19.

A second embodiment of the continuous mixing silo 21 will be explained with the aid of FIGS. 3 and 4. The essential difference between this second embodiment and the first principally is in the construction of the silo base 22.

Figure 3:
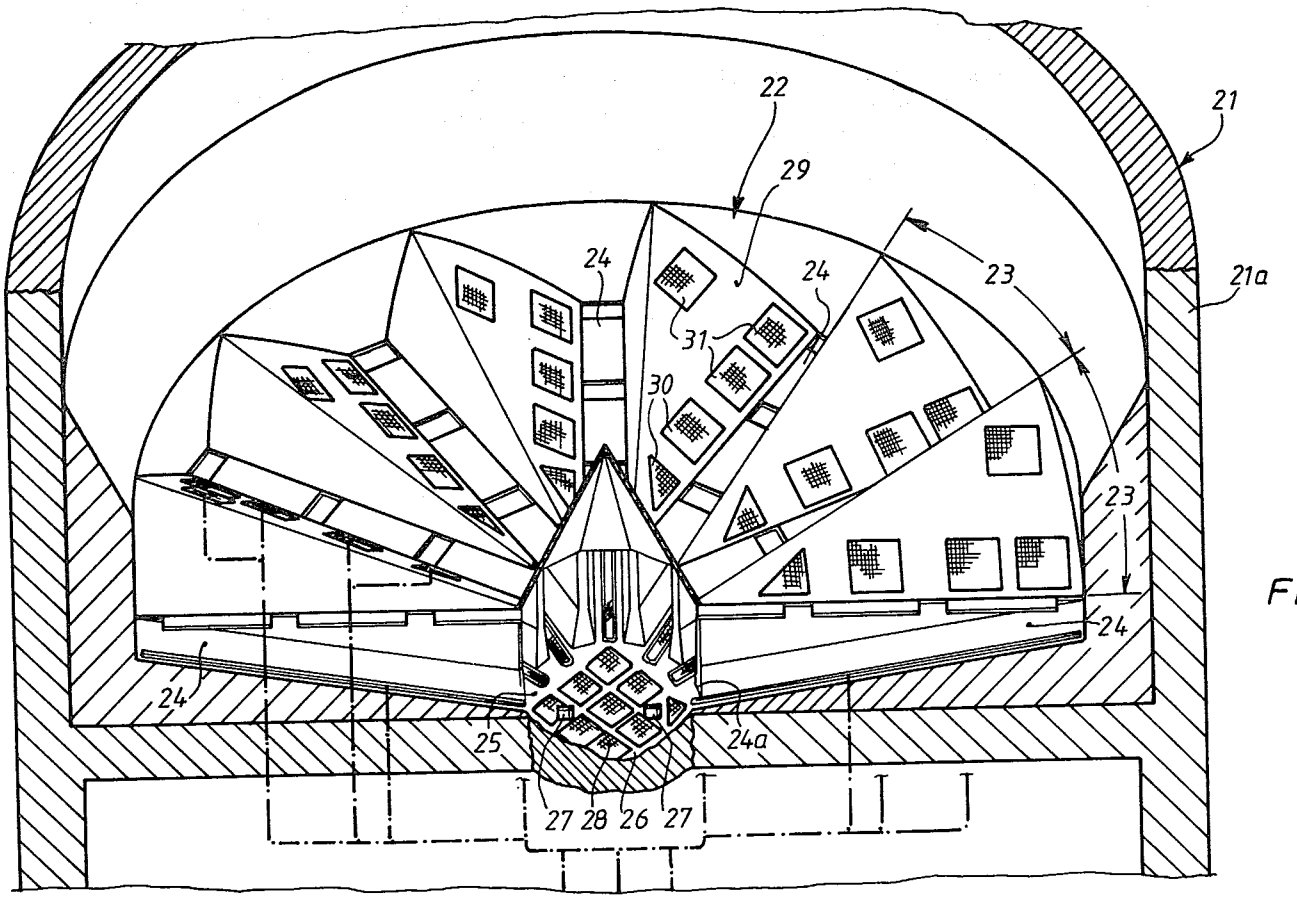
FIG. 3 is a perspective, partial vertical section through a second embodiment of a continuous mixing silo and taken approximately along the line III—III of FIG. 4.

Referring first to FIG. 3, it shows quite distinct base zones 23 which, as viewed in plan projection, are again of approximately circular sector shape. Each base zone 23 contains a discharge channel 24 which can be constructed as in the first embodiment and extends radially from the region of the external walls 21*a* of the silo to a central discharge chamber 25 into which it opens. The base 26 of this discharge chamber is in this case only slightly lower than the inner lower edges 24*a* of the discharge channels 24, and this base 26 also contains two material outlets 27 and is covered with separate air boxes 28. At least adjacent to one long side of the discharge channel 24 each base zone 23 has a surface 29 which is inclined both in the peripheral direction of the silo and in the radial direction, and a plurality of air boxes 30 and 31 which are supplied with air from below in a manner which will be explained subsequently are set into the inclined surface. The radially inner air boxes 30 are of the type which are supplied with aerating air by a fan which is not shown in greater detail in this example and which, as in the first embodiment, supplies the discharge channels 24 and the air boxes 28 of the discharge chamber 25 with aerating or conveying air. The air boxes 31 which are arranged in the radially outer region of each base zone 23 or each inclined surface 29 are of the type which are briefly supplied in a pulse-like manner with additional air which can be brought in from a compressed air storage tank with an associated charging fan in the same way as described with reference to the embodiment according to FIGS. 1 and 2.

Figure 4:
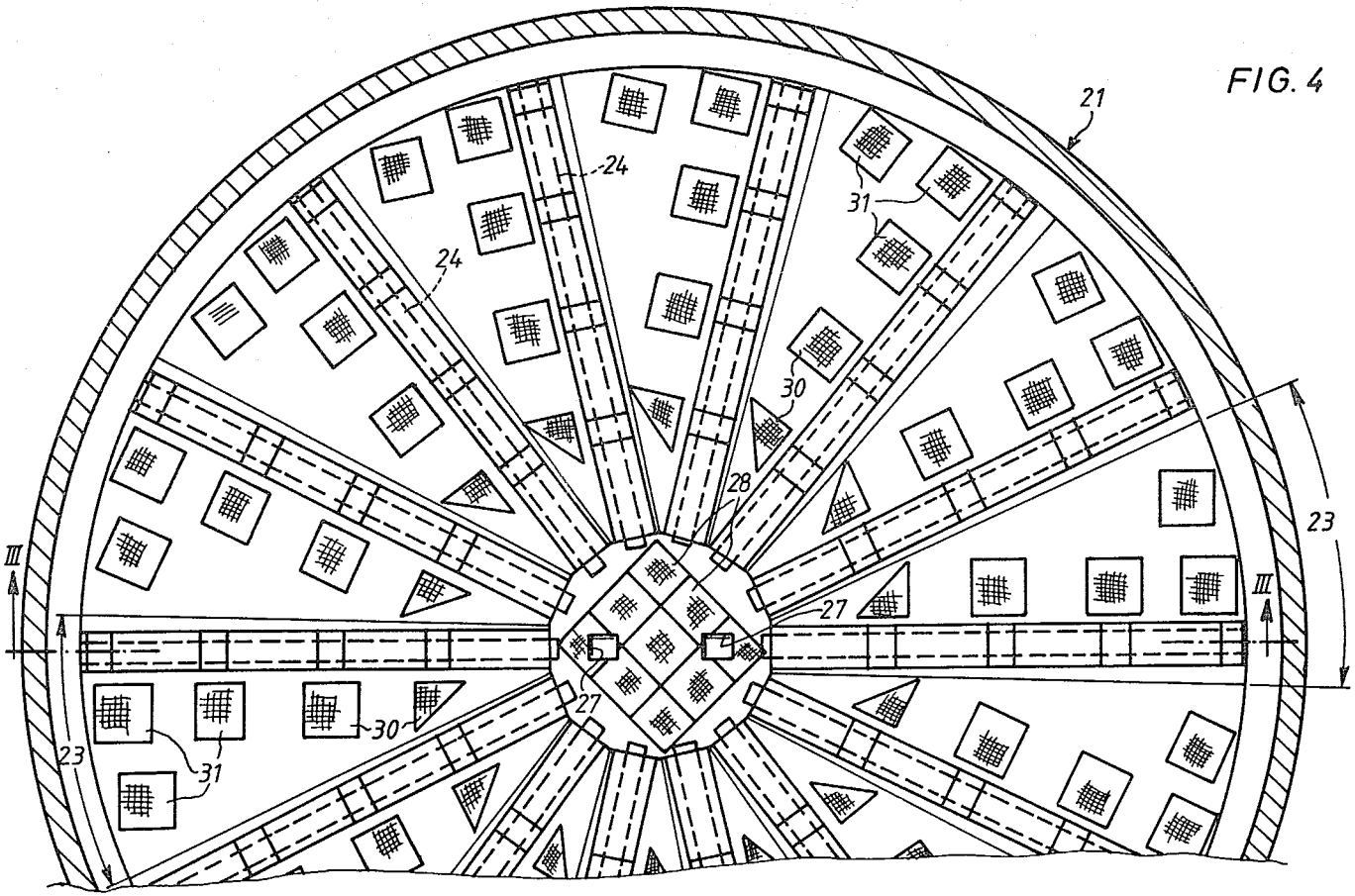
FIG. 4 is a cross-section through the silo shown in FIG. 3 and showing a portion of the base of the silo in plan.

Referring now to FIG. 4, it will be seen that the additional air boxes 31 (and in each case there are three such boxes in a base zone 23) are all arranged in a cover adjacent the outer annular section of the silo base 22. In this case, however, the aerating air boxes 30 and in each case there are two such boxes in a base zone 23, are arranged in the cover adjacent the inner annular section of the silo base 22. Also in this embodiment in each case two diametrically opposed base zones 23 are preferably supplied with aerating air during an active air supply period. Only a comparatively small quantity of aerating air is necessary for this since the total surface of the aerating air boxes 30 of each base zone 23 is considerably smaller than the total surface of the additional air boxes 31 of each base zone. This construction and arrangement of the various air boxes 30 and 31 and the construction of the inclined surfaces 29 in each base zone 23 result in an especially intensified mixing operation when the aerating air boxes 30 and the additional air boxes 31 are briefly supplied in a pulse-like manner with aerating air as described above.

Some examples for the arrangement and operation of the continuous mixing silo according to the invention which amplify the information given above are set out below:

EXAMPLE I

A continuous mixing silo according to FIGS. 1 and 2 with a silo diameter D of 20 m has an additional air supply surface area (air box 10) of approximately 2.6 $m^2$ per sector if, as shown in FIG. 2, the air boxes 10 only have a relatively short length (by comparison with the air boxes 9); if on the other hand fine material which is very difficult to mix is to be treated then correspondingly longer additional air boxes 10 are preferred and the total surface thereof can be approximately 5 $m^2$. For the pulse-like supply of additional air a quantity of approximately 7.5 $m^3$/min of air with a pressure in the compressed air storage tank 19 of approximately 6 bars is used.

EXAMPLE II

In a continuous mixing silo according to FIGS. 3 and 4, the diameter D is also 20 m, and the total surface area of the additional air boxes per sector of approximately 4.3 $m^2$ is preferred; the total surface area of the aerating air boxes 30 per sector is 2.16 $m^2$, that of the discharge chamber air boxes 28 is approximately 2.9 $m^2$, while for the discharge channels 24 a surface area which can be supplied with air of approximately 2.68 $m^2$ is provided. The quantity of additional air can be selected as equal to or greater than that provided in example I. The pressure in the compressed air storage tank remains unchanged at approximately 6 bars.

In relation to the data given in examples I and II it should be added quite generally that the quantities of air vary with the silo diameter, whereas the additional air pressure generally remains unaltered at preferably 6 bars.

EXAMPLE III

In the context of the above, it should also be noted that a silo with a diameter of approximately 8 m can have a material height ($H_g$) of approximately 24 m, and by contrast a silo with a diameter of approximately 25 m can have a material height of approximately 50 m. The quantities of both additional air and aerating air can be adapted thereto so that with a silo diameter of approximately 8 m in the quantity of additional air can be only 2 $m^3$/min and with a silo diameter of 25 m the quantity of additional air can be approximately 12 $m^3$/min (in each case with the same pressure in the storage tank of approximately 6 bars). For the supply of aerating air the following values have proved advantageous:

aerating air for discharge channels: 2 to 3 $m^3$/min per $m^2$ surface area aerating air for air boxes (9 or 30): 0.4 to 0.8 $m^3$/min per $m^2$ surface area aerating air for discharge chamber air boxes: 0.5 to 1.5 $m^3$/min per $m^2$ surface area This aerating air can be supplied at a pressure of approximately 0.6 bars (from the common fan 16).

EXAMPLE IV

In a continuous mixing silo of the construction according to FIGS. 3 and 4 the following working example has proved to be particularly favorable with a silo diameter of 20 m and a maximum material height ($H_g$) of approximately 40 m (cf. also data according to example II):

The quantities of aerating air required are 6.7 $m^3$/min (equal to 2.5 $m^3$/min per $m^2$ surface area) for the discharge channels and 1.1 $m^3$/min (equal to 0.5 $m^3$/min per $m^2$ surface area) for the aerating air boxes, whereas for the brief pulse-like supply of additional air through the additional air boxes 7.5 $m^3$/min (at approximately 1.74 $m^3$/min per $m^2$ surface area) are required.

For this the compressed air storage tank was arranged as follows:

Content: 10 $m^3$

Pressure: 6 bars

Interval of time for supply of additional air: 2 min

Time for recharging the compressed air storage tank: 4 min

In this working example the switchover time for the active air supply to each active base zone was approximately 6 minutes.

We claim:

1. In a method of operating a continuous mixing silo in the mixing of fine material and wherein the silo has a base provided with a plurality of zones to each of which aerating air is supplied individually in chronological sequence, the improvement comprising supplying additional air to each of said zones simultaneously and only while such zone is being supplied with aerating air, said additional air being supplied for a period of time less than that during which said aerating air is supplied.

2. The method according to claim 1 including supplying said additional air at a higher pressure than that of the aerating air.

3. The method according to claim 2 including maintaining a ratio of the pressure of the aerating air to the pressure of the additional air of between approximately 1:5 and 1:10.

4. The method according to claim 3 including maintaining the pressure of the additional air between about 4 and 8 bars depending on the height of the column of material in the silo.

5. The method according to claim 1 including supplying the aerating air to each of said zones for substantially the same period of time.

6. The method according to claim 1 including supplying said aerating air and said additional air to two diametrically opposed zones of the silo base simultaneously.

7. The method according to claim 1 including supplying said additional air from a store of compressed air and recharging said store during the time that additional air is not being supplied to said zone.

8. The method according to claim 1 wherein said base is circular and has a material outlet at its center, and including supplying said outlet continuously with aerating air.

9. In a continuous, fine material mixing silo having a material inlet, a circular base, a plurality of radial discharge channels spaced uniformly and circumferentially about said base and dividing said base into a plurality of circumferentially spaced zones, an aerating duct for each of said zones through which aerating air may pass for fluidising material in said zone, a material outlet in said silo base in communication with said discharge channels, and means for supplying aerating air individually to each of said zones in circumferential sequence, the improvement comprising means for supplying additional air to each of said zones simultaneously with the supply thereto of aerating air, but for a shorter period of time than that during which said aerating air is supplied to such zone.

10. A mixing silo according to claim 9 wherein the means for supplying additional air comprises additional air ducts adjacent said discharge channels.

11. A mixing silo according to claim 10 wherein said additional air ducts are alongside the associated discharge channels.

12. A mixing silo according to claim 10 wherein said additional air ducts are located adjacent the periphery of said base.

13. A mixing silo according to claim 10 wherein the surface area of each of said additional air ducts is less than that of the associated aerating air ducts.

14. A mixing silo according to claim 9 wherein said additional air is supplied at a pressure greater than that of said aerating air.

15. A mixing silo according to claim 9 including mean for continuously and uniformly aerating said material outlet.

16. A mixing silo according to claim 9 including storage means for storing said additional air under a pressure greater than that at which said aerating air is supplied to said aerating ducts.

17. A mixing silo according to claim 16 including means for recharging said storage means following the delivery of said additional air therefrom.

18. A mixing silo according to claim 9 wherein said material outlet is at a level lower than that of said base, and including a cap covering said material outlet.

19. A mixing silo according to claim 8 including means for continuously supplying said material outlet with aerating air.

* * * * *

UNITED STATES PATENT AND TRADEMARK OFFICE

CERTIFICATE OF CORRECTION

PATENT NO. : 4,472,062
DATED : September 18, 1984
INVENTOR(S) : Gerhard Balzau et al It is certified that error appears in the above-identified patent and that said Letters Patent are hereby corrected as shown below:

Column 8, line 43, change "mean" to -- means --.

Column 8, line 56, change "8" to -- 18 --.

Signed and Sealed this

*Fifth* Day of *March 1985*

[SEAL]

*Attest:*

DONALD J. QUIGG

*Attesting Officer* *Acting Commissioner of Patents and Trademarks*